US009746821B2

(12) United States Patent
Iida

(10) Patent No.: US 9,746,821 B2
(45) Date of Patent: Aug. 29, 2017

(54) IMAGE FORMING APPARATUS

(71) Applicant: FUJI XEROX CO., LTD., Tokyo (JP)

(72) Inventor: Osamu Iida, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/849,889

(22) Filed: Sep. 10, 2015

(65) Prior Publication Data

US 2016/0266537 A1 Sep. 15, 2016

(30) Foreign Application Priority Data

Mar. 13, 2015 (JP) ..... 2015-051268

(51) Int. Cl.
*G03G 21/16* (2006.01)

(52) U.S. Cl.
CPC ..... *G03G 21/1633* (2013.01); *G03G 21/168* (2013.01)

(58) Field of Classification Search
CPC ..... G03G 21/1633; G03G 21/1638; G03G 21/168
USPC ..... 399/124
See application file for complete search history.

(56) References Cited

U.S. PATENT DOCUMENTS

2010/0003051 A1* 1/2010 Sekina ..... G03G 21/168 399/121
2010/0278557 A1* 11/2010 Somemiya ..... G03G 21/1647 399/124
2011/0069990 A1* 3/2011 Tokunaga ..... G03G 21/1647 399/121

FOREIGN PATENT DOCUMENTS

JP 2010286658 A 12/2010

* cited by examiner

*Primary Examiner* — Walter L Lindsay, Jr.
*Assistant Examiner* — Philip Marcus T Fadul
(74) *Attorney, Agent, or Firm* — Oliff PLC

(57) ABSTRACT

An image forming apparatus includes: an open/close member provided to an image forming apparatus body so as to be openable and closable by turning about a turning support point; and a second transfer member attached to the open/close member to be positioned at an operation position with a positioning projecting portion contacting a positioning recessed portion of the image forming apparatus body. A distance between the turning support point and an outer peripheral end of the positioning projecting portion at a time when the open/close member is opened is shorter than the distance with the second transfer member at the operation position. The second transfer member is guided to the operation position, when the open/close member is closed, with the positioning projecting portion first contacting a guide surface of the positioning recessed portion. The guide surface is located on a downstream side along a turning direction of the open/close member.

6 Claims, 7 Drawing Sheets

IMAGE FORMING APPARATUS

CROSS-REFERENCE TO RELATED APPLICATIONS

This application is based on and claims priority under 35 USC 119 from Japanese Patent Application No. 2015-051268 filed Mar. 13, 2015.

BACKGROUND

Technical Field

The present invention relates to an image forming apparatus.

SUMMARY

According to an aspect of the present invention, there is provided an image forming apparatus including: an open/close member provided to an image forming apparatus body so as to be openable and closable by turning about a turning support point; and a second transfer member attached to the open/close member to be positioned at an operation position with a positioning projecting portion contacting a positioning recessed portion provided to the image forming apparatus body, a distance between the turning support point and an outer peripheral end of the positioning projecting portion at a time when the open/close member is opened being shorter than the distance at a time when the second transfer member is at the operation position, and the second transfer member being guided to the operation position, when the open/close member is closed, with the positioning projecting portion first contacting a guide surface of the positioning recessed portion, the guide surface being located on a downstream side along a turning direction of the open/close member.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below with reference to the drawings.

[First Exemplary Embodiment]

Figure 1:
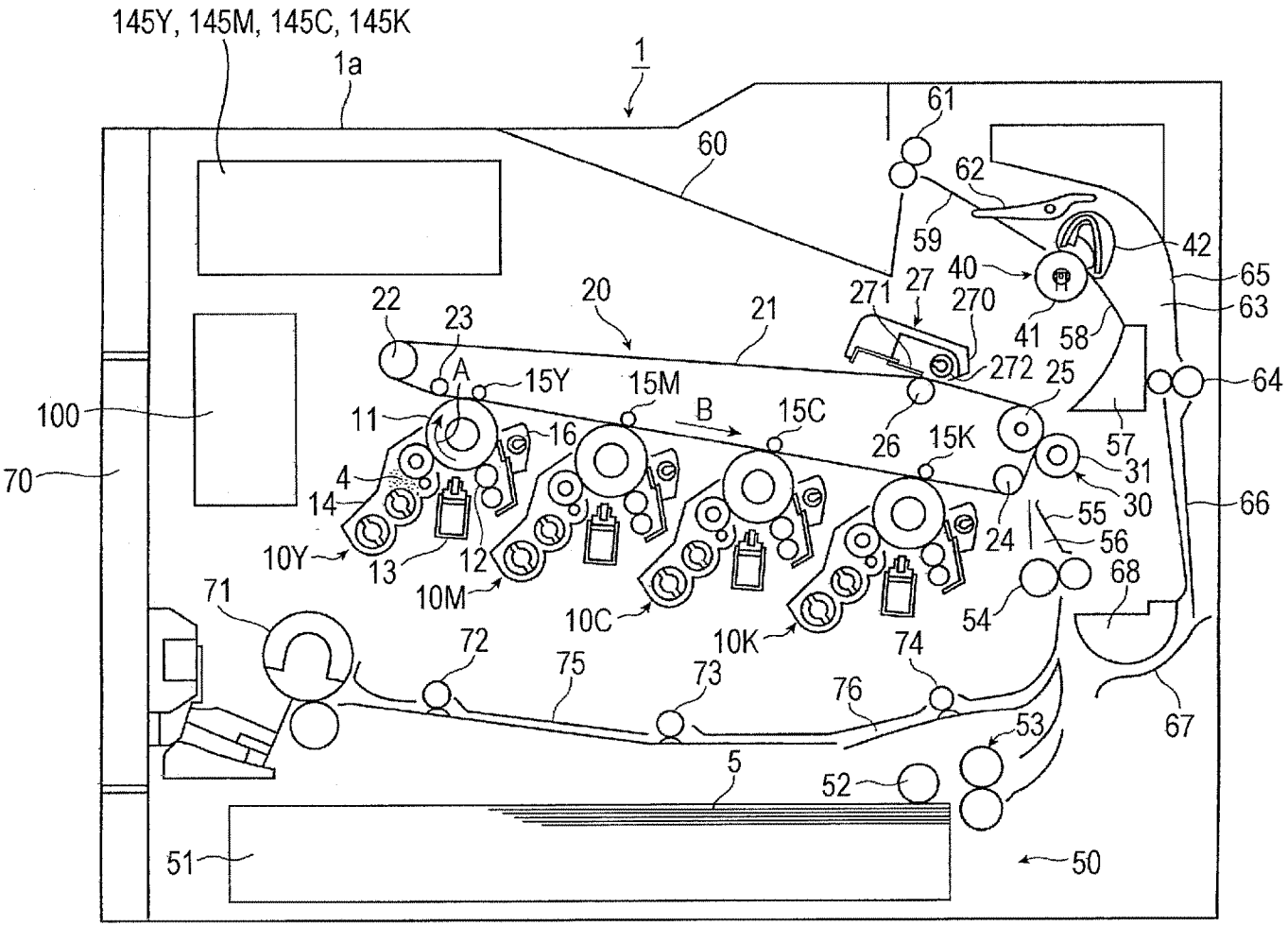
FIG. 1 illustrates the overall configuration of an image forming apparatus according to a first exemplary embodiment of the present invention.
Figure 2:
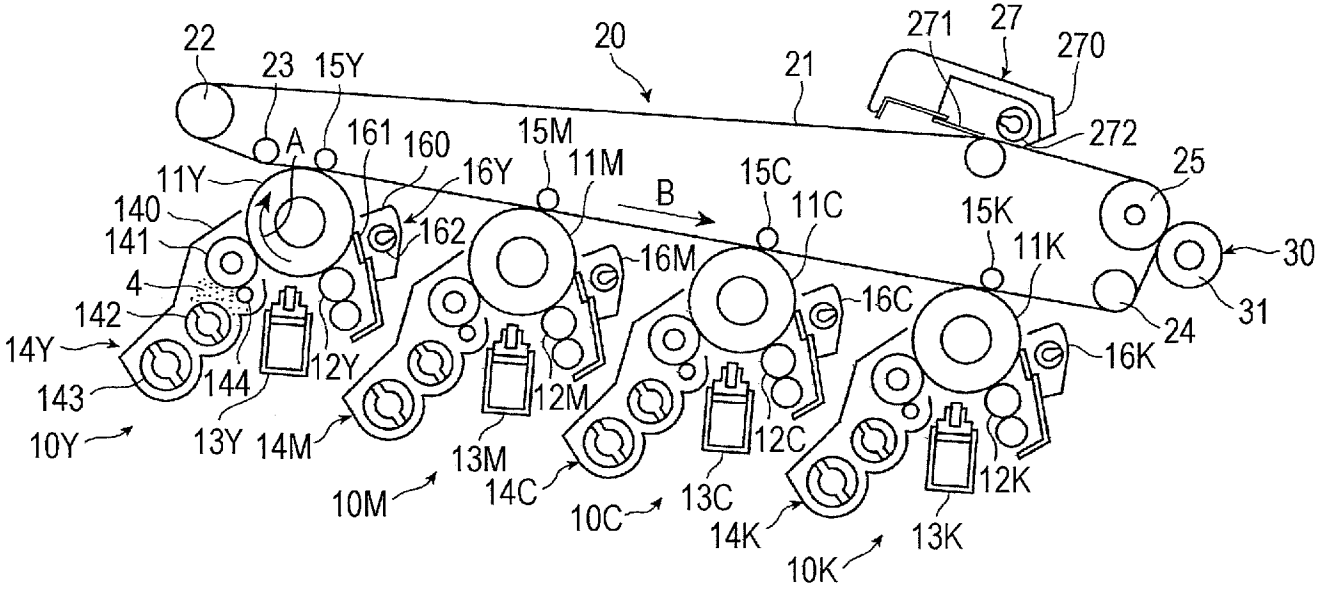
FIG. 2 illustrates the configuration of an image forming portion of the image forming apparatus according to the first exemplary embodiment of the present invention.

FIGS. 1 and 2 illustrate an image forming apparatus according to a first exemplary embodiment. FIG. 1 illustrates an overview of the entire image forming apparatus. FIG. 2 illustrates a particular portion (such as an image preparing device) of the image forming apparatus as enlarged.

<Overall Configuration of Image Forming Apparatus>

An image forming apparatus 1 according to the first exemplary embodiment is configured as a color printer, for example. The image forming apparatus 1 includes plural image preparing devices 10, an intermediate transfer device 20, a paper feed device 50, a fixing device 40, and so forth. The image preparing devices 10 form a toner image to be developed using a toner that serves as a developer 4. The intermediate transfer device 20 holds the toner images formed by the image preparing devices 10 to transport the toner images finally to a second transfer position at which the toner images are subjected to a second transfer performed onto recording paper 5 that serves as an example of a recording medium. The paper feed device 50 stores and transports the prescribed recording paper 5 to be supplied to the second transfer position of the intermediate transfer device 20. The fixing device 40 fixes the toner images on the recording paper 5 which have been subjected to the second transfer performed by the intermediate transfer device 20. In FIG. 1, reference symbol 1*a* denotes a body of the image forming apparatus 1. The body 1*a* is formed from a support structure member, an outer covering, and so forth. Members of the image forming apparatus 1 on the body 1*a* side include members such as the intermediate transfer device 20 which is mounted to the body 1*a*.

The image preparing devices 10 are composed of four image preparing devices 10Y, 10M, 10C, and 10K that exclusively form toner images in four colors, namely yellow (Y), magenta (M), cyan (C), and black (K), respectively. The four image preparing devices 10 (Y, M, C, K) are disposed side by side in line as inclined in the internal space of the body 1*a*.

The four image preparing devices 10 are composed of image preparing devices 10 (Y, M, C, K) for yellow (Y), magenta (M), cyan (C), and black (K). As illustrated in FIGS. 1 and 2, the image preparing devices 10 (Y, M, C, K) each include a rotatable photosensitive drum 11 that serves as an example of an image holding element. The following devices that serve as an example of a toner image forming unit are principally disposed around the photosensitive drum 11. The devices include a charging device 12, an exposure device 13, a developing device 14 (Y, M, C, K), a first transfer device 15 (Y, M, C, K), a drum cleaning device 16 (Y, M, C, K), and so forth. The charging device 12 charges a peripheral surface (image holding surface) of the photosensitive drum 11, on which an image may be formed, with a prescribed potential. The exposure device 13 radiates light based on information (signal) on an image to the charged peripheral surface of the photosensitive drum 11 to form an electrostatic latent image (in each color) with a potential difference. The developing device 14 (Y, M, C, K) develops the electrostatic latent image using a toner of the developer 4 for the corresponding color (Y, M, C, K) to form a toner image. The first transfer device 15 (Y, M, C, K) serves as an example of a first transfer unit that transfers the toner image to the intermediate transfer device 20. The drum cleaning device 16 (Y, M, C, K) removes attached matter such as a toner remaining on and adhering to the image holding surface of the photosensitive drum 11 after being subjected to the first transfer to clean the photosensitive drum 11.

The photosensitive drum 11 has an image holding surface formed by providing a photoconductive layer (photosensitive layer) made of a photosensitive material on the peripheral surface of a grounded cylindrical or columnar base material. The photosensitive drum 11 is supported so as to receive power from a rotary drive device (not illustrated) to rotate in the direction indicated by the arrow A.

The charging device 12 is configured as a contact charging roller disposed in contact with the photosensitive drum 11. A charging voltage is supplied to the charging device 12. In the case where the developing device 14 performs reversal development, a voltage or a current having the same polarity as the polarity for charging the toner supplied from the developing device 14 is supplied as the charging voltage. A non-contact charging device such as a scorotron disposed without contact with the surface of the photosensitive drum 11 may be used as the charging device 12.

The exposure device 13 radiates the light, formed in accordance with the information on the image input to the image forming apparatus 1, toward the peripheral surface of the photosensitive drum 11 after being charged to form an electrostatic latent image. When a latent image is to be formed, information (signal) on the image input in any manner to the image forming apparatus 1 is transmitted to the exposure device 13.

The exposure device 13 is constituted of a light emitting diode (LED) print head that radiates light matching the image information to the photoconductor drum 11 using plural LEDs that serve as light emitting elements arranged along the axial direction of the photoconductor drum 11 to form an electrostatic latent image. In the exposure device 13, deflection scanning may be performed along the axial direction of the photoconductor drum 11 using laser light configured in accordance with the image information.

As illustrated in FIG. 2, the developing devices 14 (Y, M, C, K) each include a housing 140, a developing roller 141, agitation/transport members 142 and 143, a layer thickness restricting member 144, and so forth. The housing 140 includes an opening portion and a storing chamber for the developer 4, and houses the other components. The developing roller 141 holds the developer 4, and transports the developer 4 to a development region facing the photosensitive drum 11. The agitation/transport members 142 and 143, which may be two screw augers, transport the developer 4 to cause the developer 4 to pass through the developing roller 141 while agitating the developer 4. The layer thickness restricting member 144 restricts the amount (layer thickness) of the developer held by the developing roller 141. A development voltage supplied from a power source device (not illustrated) is applied between the developing roller 141 of the developing device 14 and the photosensitive drum 11. In addition, power from a rotary drive device (not illustrated) is transmitted to the developing roller 141 and the agitation/transport members 142 and 143 to rotate the developing roller 141 and the agitation/transport members 142 and 143 in a prescribed direction. Further, a two-component developer containing a non-magnetic toner and a magnetic carrier is used as the developers 4 (Y, M, C, K) for the four colors.

The first transfer device 15 (Y, M, C, K) is a contact transfer device including a first transfer roller that rotates in contact with the periphery of the photosensitive drum 11 via an intermediate transfer belt 21 and that is supplied with a first transfer voltage. A DC voltage having a polarity opposite to the polarity for charging the toner is supplied from a power source device (not illustrated) as the first transfer voltage.

As illustrated in FIG. 2, the drum cleaning device 16 includes a body 160, a cleaning plate 161, a feeding member 162, and so forth. The body 160 has the shape of a partially open container. The cleaning plate 161 is disposed so as to contact the peripheral surface of the photosensitive drum 11, after being subjected to the first transfer, with a prescribed pressure to clean the photosensitive drum 11 by removing attached matter such as a residual toner. The feeding member 162, which may be a screw auger, recovers attached matter, such as a toner, removed by the cleaning plate 161 to feed the attached matter to a recovery system (not illustrated). A plate-like member (for example, blade) made of a material such as rubber is used as the cleaning plate 161.

As illustrated in FIG. 1, the intermediate transfer device 20 is disposed at a position above the image preparing devices 10 (Y, M, C, K). The intermediate transfer device 20 is principally composed of the intermediate transfer belt 21, plural belt support rollers 22 to 26, a second transfer device 30, and a belt cleaning device 27. The intermediate transfer belt 21 rotates in the direction indicated by the arrow B while passing through first transfer positions between the photosensitive drums 11 and the first transfer devices 15 (first transfer rollers). The belt support rollers 22 to 26 rotatably support the intermediate transfer belt 21 by holding the intermediate transfer belt 21 in a desired state from the inner side. The second transfer device (hereinafter referred to also as a "second transfer unit") 30 serves as an example of a second transfer member disposed on the outer peripheral surface (image holding surface) of the intermediate transfer belt 21 supported by the belt support roller 25 to transfer the toner image on the intermediate transfer belt 21 to the recording paper 5 through a second transfer. The belt cleaning device 27 cleans the intermediate transfer belt 21 by removing attached matter such as a toner and paper powder remaining on and adhering to the outer peripheral surface of the intermediate transfer belt 21 after passing through the second transfer device 30.

An endless belt fabricated from a material obtained by dispersing a resistance adjusting agent such as carbon black etc. in a synthetic resin such as a polyimide resin or a polyamide resin, for example, is used as the intermediate transfer belt 21. The belt support roller 22 is configured as a driving roller rotationally driven by a drive device (not illustrated). The belt support roller 23 is configured as a driven roller that maintains the travel position etc. of the intermediate transfer belt 21. The belt support roller 24 is configured as a tension applying roller that applies tension to the intermediate transfer belt 21. The belt support roller 25 is configured as a second transfer back-up roller. The belt support roller 26 is configured as a driven roller that supports the intermediate transfer belt 21 contacted by the belt cleaning device 27 from the back surface side.

As illustrated in FIG. 1, the second transfer device 30 is a contact transfer device including a second transfer roller 31 provided at the second transfer position, which is a portion of the outer peripheral surface of the intermediate transfer belt 21 supported by the belt support roller 25 in the intermediate transfer device 20. The second transfer roller 31 rotates in contact with the peripheral surface of the intermediate transfer belt 21, and is supplied with a second transfer voltage. A DC voltage having a polarity opposite to or the same as the polarity for charging the toner is supplied as the second transfer voltage to the second transfer device 31 or the support roller 25 of the intermediate transfer device 20. The configuration of the second transfer device 30 will be discussed in detail later as a specific portion of the image forming apparatus.

As illustrated in FIG. 2, the belt cleaning device 27 includes a body 270, a cleaning plate 271, a feeding member 272, and so forth. The body 270 has the shape of a partially open container. The cleaning plate 271 is disposed so as to contact the peripheral surface of the intermediate transfer belt 21, after being subjected to the second transfer, with a prescribed pressure to clean the intermediate transfer belt 21 by removing attached matter such as a residual toner. The feeding member 272, which may be a screw auger, recovers attached matter, such as a toner, removed by the cleaning plate 271 to feed the attached matter to a recovery system (not illustrated).

As illustrated in FIG. 1, the fixing device 40 is composed of a heating rotary member 41, a pressurizing rotary member 42, and so forth. The heating rotary member 41, which may be in the form of a drum or a belt, is heated by a heating unit such that the surface temperature is maintained at a prescribed temperature. The pressurizing rotary member 42, which may be in the form of a drum or a belt, rotates in contact with the heating rotary member 41 at a predetermined pressure in the state of being substantially parallel to the axial direction of the heating rotary member 41. In the fixing device 40, a contact portion at which the heating rotary member 41 and the pressurizing rotary member 42 contact each other serves as a fixation processing part at which a prescribed fixation process (heating and pressurization) is performed.

The paper feed device 50 is disposed at a position below the image preparing devices 10 (Y, M, C, K) for yellow (Y), magenta (M), cyan (C), and black (K). The paper feed device 50 is principally composed of one or more paper storing members 51 and feeding devices 52 and 53. The paper storing members 51 store a stack of sheets of the recording paper 5 of desired size, type, etc. The feeding devices 52 and 53 feed the recording paper 5, one sheet at a time, from the paper storing members 51. The paper storing members 51 are attached so as to be drawn out toward the front surface (a side surface that the user faces during operation) of the body 1*a*, that is, toward the left side surface in the illustrated example, for example.

Examples of the recording paper 5 include regular paper and overhead projector (OHP) sheets for use for electrophotographic copiers and printers. In order to further improve the smoothness of the surface of an image after being fixed, the surface of the recording paper 5 is preferably as smooth as possible. For example, coated paper prepared by coating the surface of regular paper with a resin or the like, so-called cardboard with a relatively large basis weight such as art paper for printing, and so forth may also be used.

A paper feed/transport path 56 is provided between the paper feed device 50 and the second transfer device 30. The paper feed/transport path 56 is composed of one or more pairs of paper transport rollers 54, a transport guide 55, and so forth. The pair of paper transport rollers 54 transport the recording paper 5 fed from the paper feed device 50 to the second transfer position. The pair of paper transport rollers 54 are configured as rollers (resist rollers) that adjust the timing to transport the recording paper 5, for example. Transport guides 57 and 58 etc. are provided between the second transfer device 30 and the fixing device 40. The transport guides 57 and 58 transport the recording paper 5 after being subjected to the second transfer fed from the second transfer roller 31 of the second transfer device 30 to the fixing device 40. Further, a pair of paper ejection rollers 61 are disposed near a paper ejection port formed in the body 1*a*. The pair of paper ejection rollers 61 eject the recording paper 5 after the fixation process fed from the fixing device 40 to a paper ejection portion 60 provided at the upper portion of the body 1*a* along a transport guide 59.

A switching gate 62 that switches the paper transport path is provided between the fixing device 40 and the pair of paper ejection rollers 61. The rotational direction of the pair of paper ejection rollers 61 is switchable between the forward direction (ejection direction) and the reverse direction. In the case where an image is to be formed on both surfaces of the recording paper 5, the rotational direction of the pair of paper ejection rollers 61 is switched from the forward direction (ejection direction) to the reverse direction after the rear end of the recording paper 5, on one surface of which an image has been formed, passes through the switching gate 62. The transport path for the recording paper 5 which is transported in the reverse direction by the pair of paper ejection rollers 61 is switched by the switching gate 62 such that the recording paper 5 is transported to a two-sided printing transport path 63 formed along substantially the vertical direction. The two-sided printing transport path 63 includes a pair of paper transport rollers 64, transport guides 65 to 68, and so forth. The pair of paper transport rollers 64 transport the recording paper 5 to the pair of paper transport rollers 54 with the front and back sides of the recording paper 5 reversed.

In FIG. 1, reference numeral 70 denotes a manual feed tray provided on the front surface (in the drawing, left side surface) of the body 1*a* of the image forming apparatus 1 so as to be openable and closable. A feeding device 71 and a manual paper feed/transport path 76 are provided between the manual feed tray 70 and the pair of paper transport rollers 54. The feeding device 71 feeds the recording paper 5 housed in the manual feed tray 70, one sheet at a time. The manual paper feed/transport path 76 is composed of plural pairs of paper transport rollers 72 to 74, a transport guide 75, and so forth.

In FIG. 1, reference numeral 145 (Y, M, C, K) denotes each of plural toner cartridges that serve as developer storing containers that are arranged along a direction orthogonal to the sheet surface and that store a developer containing at least a toner to be supplied to the corresponding developing devices 14 (Y, M, C, K).

In FIG. 1, in addition, reference numeral 100 denotes a control device that comprehensively controls operation of the image forming apparatus 1. The control device 100 includes a central processing unit (CPU), a read only memory (ROM), a random access memory (RAM), a bus that connects between the CPU, the ROM, etc., a communication interface, and so forth (not illustrated).

<Operation of Image Forming Apparatus>

Basic image forming operation performed by the image forming apparatus 1 will be described below.

Operation for forming a full-color image by combining toner images in four colors (Y, M, C, K) using the four image preparing devices 10 (Y, M, C, K) will be described.

When the image forming apparatus 1 receives command information requesting image forming operation (printing), the four image preparing devices 10 (Y, M, C, K), the intermediate transfer device 20, the second transfer device 30, the fixing device 40, and so forth are started.

In each of the image preparing devices 10 (Y, M, C, K), first, the photosensitive drum 11 rotates in the direction indicated by the arrow A, and the charging device 12 charges the surface of the photosensitive drum 11 with a prescribed polarity (in the first exemplary embodiment, negative polarity) and a predefined potential. Then, the exposure device 13 radiates the surface of the photosensitive drum 11 after being charged with light emitted on the basis of a signal for an image obtained by converting information on an image input to the image forming apparatus 1 into each color component (Y, M, C, K). Thus, an electrostatic latent image for each color component with a prescribed potential difference is formed on the surface of the photosensitive drum 11.

Then, the developing device 14 (Y, M, C, K) develops the electrostatic latent image for each color component formed on the photosensitive drum 11 by supplying a toner for the corresponding color (Y, M, C, K) charged with a prescribed polarity (negative polarity) from the developing roller 141 for electrostatic adhesion. As a result of the development, the electrostatic latent images for the various color components formed on the photosensitive drums 11 are rendered manifest as toner images in the four colors (Y, M, C, K) developed using toners for the corresponding colors.

Then, when the toner image in each color formed on the photosensitive drum 11 of the image preparing device 10 (Y, M, C, K) is transported to the first transfer position, the first transfer device 15 performs a first transfer on the toner image in each color such that the toner images in the various colors are sequentially superposed on the intermediate transfer belt 21 of the intermediate transfer device 20 which rotates in the direction indicated by the arrow B.

In the image preparing devices 10 which have finished the first transfer, the drum cleaning device 16 removes, or scrapes off, attached matter to clean the surface of the photosensitive drum 11. This allows the image preparing devices 10 to be ready for the next image preparing operation.

Then, the intermediate transfer device 20 transports the toner images which have been subjected to the first transfer to the second transfer position through rotation of the intermediate transfer belt 21. Meanwhile, the paper feed device 50 feeds the prescribed recording paper 5 to the paper feed/transport path 56 in accordance with the image preparing operation. In the paper feed/transport path 56, the pair of paper transport rollers 54 that serve as resist rollers feed the recording paper 5 to the second transfer position in accordance with the transfer timing to supply the recording paper 5.

At the second transfer position, the second transfer roller 31 of the second transfer device 30 collectively performs a second transfer of the toner images on the intermediate transfer belt 21 onto the recording paper 5. In the intermediate transfer device 20 which has finished the second transfer, the belt cleaning device 27 removes attached matter such as a toner remaining on the surface of the intermediate transfer belt 21 after the second transfer.

Then, the recording paper 5, onto which the toner images have been transferred through the second transfer, is peeled from the intermediate transfer belt 21 and the second transfer roller 31, and thereafter transported to the fixing device 40 via the transport guides 57 and 58. In the fixing device 40, the recording paper 5 after being subjected to the second transfer is introduced to the contact portion between the heating rotary member 41 and the pressurizing rotary member 42 which are rotating to pass through the contact portion to perform a necessary fixation process (heating and pressurization) to fix unfixed toner images to the recording paper 5. Lastly, in the case of image forming operation in which an image is to be formed on only one surface of the recording paper 5, the recording paper 5 after being subjected to the fixation is ejected to the paper ejection portion 60 provided at the upper portion of the body 1*a*, for example, by the pair of paper ejection rollers 61.

In the case where an image is to be formed on both surfaces of the recording paper 5, meanwhile, all of the recording paper 5 on one surface of which an image has been formed is not ejected to the paper ejection portion 60 by the pair of paper ejection rollers 61, and the rotational direction of the pair of paper ejection rollers 61 is switched to the reverse direction while the pair of paper ejection rollers 61 hold the rear end of the recording paper 5. The recording paper 5 transported in the opposite direction by the pair of paper ejection rollers 61 passes over the switching gate 62, and thereafter is transported to the pair of paper transport rollers 54, with the front and back sides of the recording paper 5 reversed, via the two-sided printing transport path 63 which includes the pair of paper transport rollers 64, the transport guides 65 to 68, and so forth. The pair of paper transport rollers 54 feed the recording paper 5 to the second transfer position in accordance with the transfer timing so that an image is formed on the back surface of the recording paper 5. The recording paper 5 is ejected to the paper ejection portion 60 provided at the upper portion of the body 1*a* by the pair of paper ejection rollers 61.

As a result of the operation described above, the recording paper 5 is output with a full-color image formed thereon by combining the toner images in the four colors.

<Configuration of Specific Portion of Image Forming Apparatus>

Figure 3:
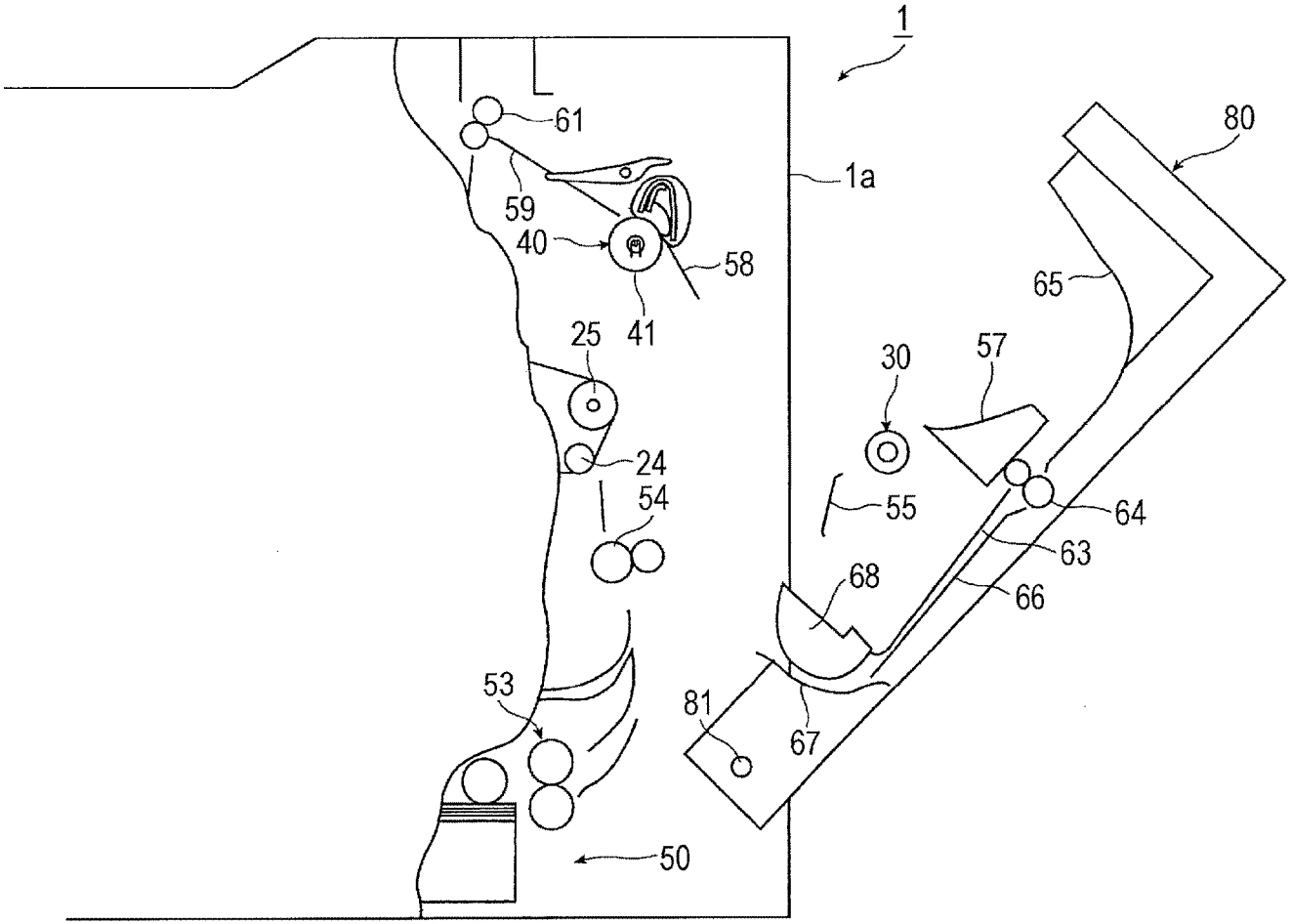
FIG. 3 illustrates a schematic configuration, as partially cut away, of the image forming apparatus according to the first exemplary embodiment of the present invention in a state in which a rear cover is opened.

As illustrated in FIG. 3, the image forming apparatus 1 according to the first exemplary embodiment includes a rear cover 80 on one surface (e.g. back surface) side, which is the right surface side in the illustrated example, of the body 1*a* of the image forming apparatus 1. The rear cover 80 serves as an example of an open/close member. The rear cover 80 is attached so as to be openable and closable (turnable) in the clockwise direction in the drawing by turning about a first turning support point 81 provided at the lower portion of the body 1*a* on the back surface side with respect to the body 1*a* of the image forming apparatus 1. The rear cover 80 is opened and closed to remove the recording paper 5, for example, as necessary when a paper jam (a so-called "jam") of the recording paper 5 occurs in the paper transport path 56, the second transfer device 30, the transport guides 57, 58, and 59, the fixing device 40 or the two-sided printing transport path 63, for example.

As illustrated in FIG. 3, the rear cover 80 is formed in an inverted L-shape in a side view so as to cover the back surface of the image forming apparatus body 1*a* as an outer covering that includes a support structure member etc. The rear cover 80 includes members such as the second transfer device 30, the transport guides 55 and 57, and the pair of paper transport rollers 64 and the transport guides 65, 66, 67, and 68 which compose the two-sided printing transport path 63. FIG. 3 illustrates the members attached to the rear cover 80 in a convenient positional relationship with respect to the rear cover 80, and it is a matter of course that the second transfer device 30, the transport guides 55 and 57, and so forth are attached at prescribed positions of the rear cover 80 as discussed later.

Figure 4:
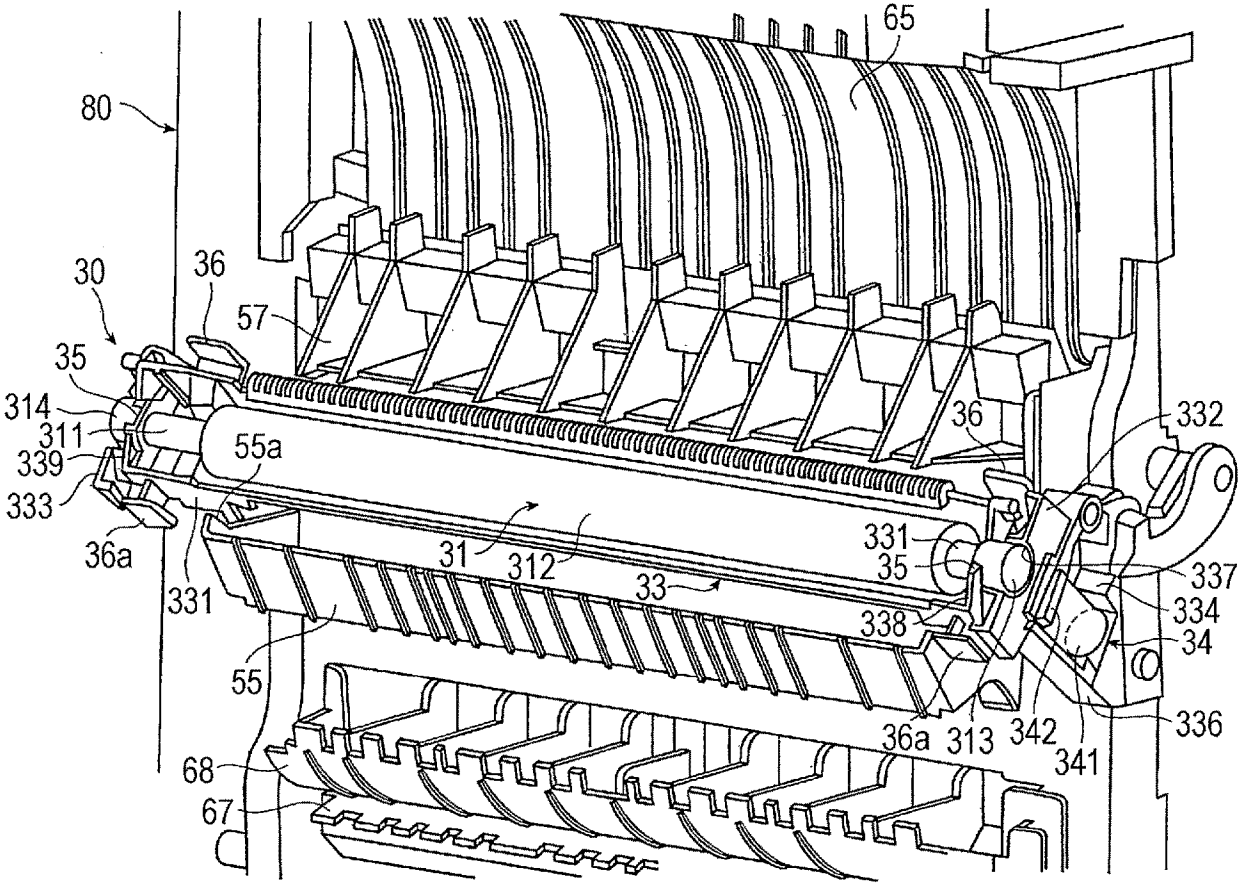
FIG. 4 is a perspective view illustrating the configuration of an inner surface of the rear cover.
Figure 5:
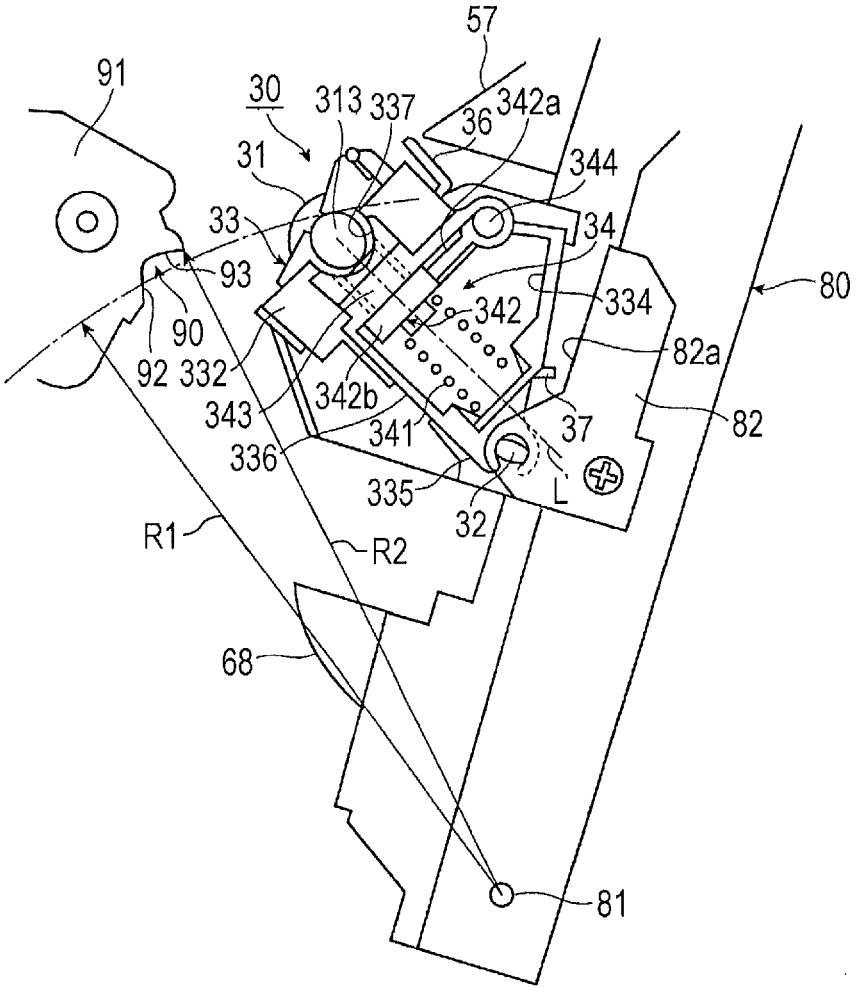
FIG. 5 is a side view illustrating a state in which the rear cover is opened from a body of the image forming apparatus.
Figure 6:
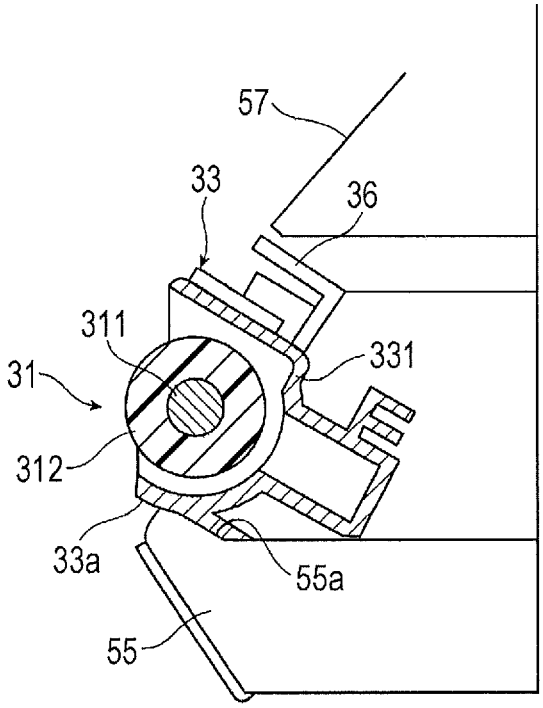
FIG. 6 is a sectional view illustrating the configuration of a second transfer unit attached to the rear cover.

As illustrated in FIGS. 4 to 6, the second transfer device 30 is constituted as a second transfer unit integrally unitized and including the second transfer roller 31. The second transfer unit 30 is attached to the rear cover 80 so as to be turnable about a second turning support point 32 (see FIG. 5) positioned on the rear cover 80 side with respect to the second transfer roller 31. The second transfer unit 30 includes the second transfer roller 31, a housing 33, and a pressing mechanism 34. The housing 33 serves as an example of a support member that rotatably supports the second transfer roller 31. The pressing mechanism 34 serves as an example of a pressing unit provided at both end portions of the housing 33 along the longitudinal direction to press the second transfer roller 31 toward the back-up roller 25.

As illustrated in FIG. 6, the second transfer roller 31 includes a rotary shaft 311 and an elastic body layer 312. The rotary shaft 311 serves as a core metal member made of metal such as stainless steel. The elastic body layer 312 is applied to the outer periphery of the rotary shaft 311 to a prescribed thickness, and is conductive. It is not necessary that the outside diameter of the rotary shaft 311 should be constant over the entire length along the axial direction, and the outside diameter of a region of the rotary shaft 311 to which the elastic body layer 312 is applied may be large compared to that at both end portions. As illustrated in FIG. 4, the rotary shaft 311 of the second transfer roller 31 is rotatably supported by bearing members 313 and 314 that also function as positioning members. The outer peripheral end portions of the bearing members 313 and 314, which are formed in a projecting shape such as a circular shape or an elliptical shape, constitute positioning projecting portions of the second transfer unit 30.

As illustrated in FIG. 6, the housing 33 includes a body 331 formed to be elongated along the axial direction of the second transfer roller 31. The body 331 of the housing 33 is formed in a substantially recessed shape in section so as to be able to house the second transfer roller 31. As illustrated in FIG. 5, the body 331 of the housing 33 is attached to the rear cover 80 so as to be turnable about the second turning support point 32. As illustrated in FIG. 4, holding members 332 and 333 in a substantially rectangular shape in a side view are provided at both end portions of the housing 33 along the longitudinal direction, integrally with or separately from the body 331. The holding members 332 and 333 rotatably hold the second transfer roller 31. As illustrated in FIG. 5, the holding members 332 and 333 have a recess 334 that is open in a side surface. The pressing mechanism 34 is housed in the recess 334. The holding members 332 and 333 integrally include a support portion 336 provided with a turning portion 335 turnably mounted to the second turning support point 32. The second turning support point 32 is formed in a flat plate shape having a support surface formed in an arcuate shape at both ends. The turning portion 335 is formed in a cylindrical shape having an opening portion that is wider than the thickness of the second turning support point 32, and attached to the second turning support point 32 via the opening portion. In the illustrated exemplary embodiment, the second turning support point 32 is provided to a bracket 82 attached to the inside surface of the rear cover 80. As a matter of course, the second turning support point 82 may be directly provided to the rear cover 80.

As illustrated in FIGS. 4 and 5, the holding members 332 and 333 has a recessed portion 337 in a semicircular shape in a side view to house the bearing members 313 and 314. A support plate 35 made of metal or a synthetic resin is attached to the bearing members 313 and 314. The bearing members 313 and 314 are held in a retained state by holding pieces 338 and 339 in a substantially triangular shape in a side view provided to the housing 33 via the support plate 35.

The housing 33 includes an attachment/detachment lever 36 for attachment and detachment of the second transfer roller 31 to and from the housing 33. When the attachment/detachment lever 36 is pushed, a projecting portion (not illustrated) of the attachment/detachment lever 36 is disengaged from a recessed portion (not illustrated) of the holding members 332 and 333, and the second transfer roller 31 is detached together with the housing 33 and the bearing members 313 and 314. That is, the housing 33 to which the second transfer roller 31 is rotatably attached via the bearing members 313 and 314 is removably mounted to the holding members 332 and 333. When the attachment/detachment lever 36 is operated, the housing 33 becomes detachable from the holding members 332 and 333 with the projecting portion (not illustrated), which is provided to the attachment/detachment lever 36, disengaged from the recessed portion (not illustrated) of the holding members 332 and 333. In FIG. 4, reference symbol 36*a* denotes a grasping portion on which the user places his/her finger to operate the attachment/detachment lever 36.

As illustrated in FIG. 5, the pressing mechanism 34 includes a coil spring 341, a stopper 342, and a pressing member 343. The coil spring 341 serves as an example of an elastic member, and has been compressed. The stopper 342 receives the pressing force of the coil spring 341. The pressing member 343 is constituted integrally with or separately from the stopper 342, and presses the bearing members 313 and 314. The pressing member 343 is a circular column or rectangular tube member principally indicated by the broken line in FIG. 5, and is stopped at a position at which an exposed end portion of the pressing member 343 contacts the bearing member 313. The stopper 342 is attached to the recess 334 of the holding members 332 and 333 so as to be turnable about a third turning support point 344 along the counterclockwise direction in the drawing. The stopper 342 includes an arm portion 342*a* and a pressure receiving plate portion 342*b*. The arm portion 342*a* extends along a radial direction from the third turning support point 344. The pressure receiving plate portion 342*b* is integrally provided at the distal end of the arm portion 342*a*. The coil spring 341 is housed in a compressed state between the pressure receiving plate portion 342*b* of the stopper 342 and the bottom portion of the recess 334 of the holding members 332 and 333. An elastic force in the clockwise direction in the drawing is applied to the stopper 342 by the pressing force of the coil spring 341. The stopper 342 is stopped with the pressure receiving plate portion 342*b* in contact with the ceiling portion of the recess 334 of the holding members 332 and 333. Therefore, the pressing force of the coil spring 341 is not applied to the bearing members 313 and 314 of the second transfer roller 31 via the pressing member 343 when the rear cover 80 is opened.

With the bearing members 313 and 314 of the second transfer roller 31 positioned at an operation position of a positioning recessed portion 90 on the image forming apparatus body 1*a* side, on the other hand, the bearing members 313 and 314 of the second transfer roller 31 are positioned in a constantly displaced state in which the bearing members 313 and 314 are spaced away from the back-up roller 25 by a distance determined in advance. In this event, the bearing members 313 and 314 are displaced toward the rear cover 80 by the distance determined in advance. This is because in a state in which the bearing members 313 and 314 are positioned at the operation position, the bearing members 313 and 314 are set so as to be rotated in the clockwise direction from the state illustrated in FIG. 5 about the second turning support point 32, and the length of a side formed between the second turning support point 32 and the outer peripheral end of the bearing members 313 and 314, of a triangle formed by the first turning support point 81, the second turning support point 32, and the outer peripheral end of the bearing members 313 and 314, becomes shorter along with rotation of the bearing members 313 and 314. Therefore, the bearing members 313 and 314 are displaced toward the rear cover 80 (rightward and obliquely downward in FIG. 5) against the pressing force of the coil spring 341 by an amount by which the side formed between the second turning support point 32 and the outer peripheral end of the bearing members 313 and 314 has been shortened. When the bearing members 313 and 314 are displaced toward the rear cover 80 by the distance determined in advance, the pressure receiving plate portion 342*b* of the stopper 342 is pressed via the pressing member 343, and the stopper 342 is turned in the counterclockwise direction in FIG. 5 by a slight angle to be spaced away from the ceiling portion of the recess 334 of the holding members 332 and 333. Therefore, the coil spring 341 is further compressed from the state illustrated in FIG. 5, and a pressing force that matches the amount of compression of the coil spring 341 is applied to the second transfer roller 31 via the stopper 342, the pressing member 343, and the bearing members 313 and 314. The pressing force of the coil spring 341 is set to about 4 kgf for one side, for example.

The second transfer unit 30 has the second turning support point 32 at a position closer to the rear cover 80 than the second transfer roller 31 and at a position closer to the first turning support point 81 of the rear cover 80 than the second transfer roller 31 when the rear cover 80 is opened. Therefore, in the state illustrated in FIG. 5, a force that turns the second transfer unit 30 in the counterclockwise direction is applied to the second transfer unit 30 because of its own weight. In this event, as illustrated in FIG. 6, the second transfer unit 30 is stopped with an outside surface 33*a* of the housing 33 on the image forming apparatus body 1*a* side in contact with an inside surface 55*a* (see FIG. 4) positioned at the upper end portion of the transport guide 55 which is provided to the rear cover 80.

As illustrated in FIG. 5, the second transfer unit 30 includes a projecting abutment portion 37 that is provided on a side surface on the rear cover 80 side. The abutment portion 37 is provided at a position in an area closer to the second turning support point 32. The abutment portion 37 abuts against an inner surface 82*a* of the rear cover 80 (in the illustrated example, a side surface of the bracket 82) to restrict the position of the second transfer unit 30.

In the pressing mechanism 34 according to the exemplary embodiment, the second turning support point 32, which serves as one of the support points which support the pressing force, is provided not on a line of action L of the pressing force of the pressing mechanism 34 but at a position displaced to one side (downward in the illustrated example) from the line of action L, and the abutment portion 37, which is brought into abutment with the rear cover 80 to serve as the other of the support points which support the pressing force, is provided on the opposite side across the line of action L of the pressing force of the pressing mechanism 34. Therefore, the pressing mechanism 34 supports the pressing force of the coil spring 341 of the pressing mechanism 34 separately at two locations, namely the second turning support point 32 and the abutment portion 37. The structure for supporting the pressing force of the coil spring 341 is simplified compared to a case where the pressing force of the coil spring 341 is supported at one location.

With the rear cover 80 fully open, the second transfer roller 31 is moved to a position beyond the second turning support point 32, and therefore a force that turns the second transfer roller 31 in the clockwise direction is applied to the second transfer roller 31 because of its own weight. However, the second transfer unit 30 is stopped with the abutment portion 37 abutting against the inner surface 82*a* of the rear cover 80.

As illustrated in FIG. 5, the positioning recessed portion 90 is provided to the body 1*a* of the image forming apparatus 1. The positioning recessed portion 90 contacts the outer peripheral portion (positioning projecting portion) of the bearing members 313 and 314 of the second transfer unit 30 to position the second transfer roller 31 of the second transfer unit 30 at the prescribed operation position. The positioning recessed portion 90 is disposed at both end portions along the axial direction of the back-up roller 25 of the intermediate transfer device 20, and provided at the same position of a pair of frame members 91 that rotatably support the back-up roller 25. The pair of frame members 91 are fixed to the image forming apparatus body 1*a*. In FIG. 5, the double circle in the frame members 91 indicates the position of the rotational axis of the back-up roller 25.

The positioning recessed portion 90 is formed at an end portion of the pair of frame members 91 on the rear cover 80 side. The positioning recessed portion 90 has a substantially V-shape having a prescribed opening angle that is preferably laterally symmetric with respect to a line that connects between the respective centers of the second transfer roller 31 and the back-up roller 25 at the operation position. The opening angle of the positioning recessed portion 90 is set to about 100 to 130°, for example. However, the opening angle is not limited thereto.

The positioning recessed portion 90 has a first guide surface 92 and a second guide surface 93. The first guide surface 92 is straight, and positioned on the downstream side along the direction of closing the rear cover 80. The second guide surface 93 is also straight, and positioned on the upstream side. The bearing members 313 and 314 of the second transfer unit 30 are stopped at a position at which the outer peripheral surface of the bearing members 313 and 314 contacts both the first and second guide surfaces 92 and 93 of the positioning recessed portion 90, and the position at which the bearing members 313 and 314 are stopped is set to the operation position of the second transfer roller 31.

A distance R1 between the first turning support point 81 of the rear cover 80 and the outer peripheral end of the bearing members 313 and 314 at the time when the rear cover 80 is opened is shorter than the distance with the second transfer unit 30 at the operation position. A further description follows. When the rear cover 80 is opened, the second transfer unit 30 is positioned at a position at which the second transfer unit 30 has been slightly turned in the counterclockwise direction about the second turning support point 32, and the length of a side that connects between the first turning support point 81 and the center of the rotary shaft 311 of the second transfer roller 31, of a triangle formed from the first turning support point 81, the second turning support point 32, and the center of the rotary shaft 311 of the second transfer roller 31, is shorter than the length at the operation position.

When the rear cover 80 is fully closed, on the other hand, the distance between the first turning support point 81 of the rear cover 80 and the outer peripheral end of the bearing members 313 and 314 is equal to the distance with the second transfer unit 30 at the operation position. When the rear cover 80 is fully closed, the second transfer unit 30 is displaced to a position at which the second transfer unit 30 has been slightly turned in the clockwise direction about the second turning support point 32, and the length of a side that connects between the first turning support point 81 and the center of the rotary shaft 311 of the second transfer roller 31, of a triangle formed from the first turning support point 81, the second turning support point 32, and the center of the rotary shaft 311 of the second transfer roller 31, is varied to a prescribed length at the operation position that is longer than the length at the open position along with the turn of the second transfer unit 30 in the clockwise direction. The length at the operation position is achieved in the constantly displaced state in which the distance between the centers of the second transfer roller 31 of the second transfer unit 30 and the back-up roller 25 on the image forming apparatus body 1*a* side has a prescribed value. In this event, the bearing members 313 and 314 are brought into press contact with the positioning recessed portion 90 by the pressing force (e.g. about 4 kgf for one side) of the coil spring 341 of the second transfer unit 30.

<Operation of Specific Portion of Image Formation Apparatus>

In the image forming apparatus 1 according to the first exemplary embodiment, as illustrated in FIG. 3, the rear cover 80 is turned in the clockwise direction about the first turning support point 81 to be opened as necessary when a paper jam (a so-called "jam") of the recording paper 5 occurs in the paper transport path 56, the second transfer device 30, the transport guides 57, 58, and 59, the fixing device 40, or the two-sided printing transport path 63.

Figure 7A:
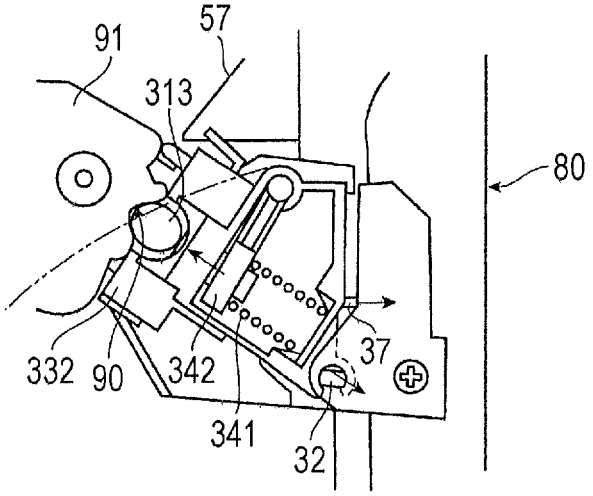
FIG. 7A is a side view illustrating a state in which the rear cover is closed.
Figure 7B:
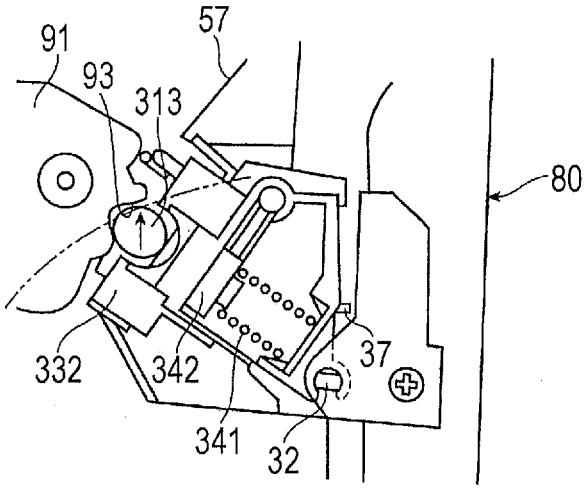
FIG. 7B is a side view illustrating a state in which the rear cover is slightly opened.
Figure 7C:
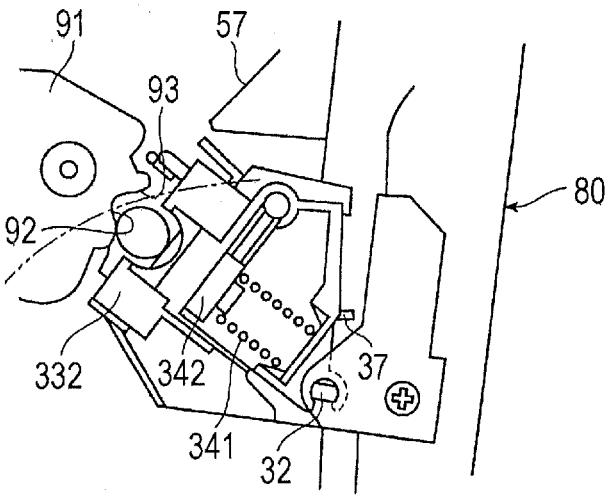
FIG. 7C is a side view illustrating a state in which the rear cover is further opened.

When the rear cover 80 is opened, as illustrated in FIGS. 7A to 7C, the second transfer unit 30 is turned in the counterclockwise direction about the second turning support point 32 by its own weight from a state (FIG. 7A) in which the rear cover 80 is fully closed, and moved until the housing 33 of the second transfer unit 30 is stopped in abutment with the transport guide 55 (see FIG. 6). In this event, as illustrated in FIG. 7B, the abutment portion 37 of the second transfer unit 30 is spaced away from the inner surface 82*a* of the rear cover 80, and a pressing force from the inner surface of the rear cover 80 is not applied to the abutment portion 37. Therefore, the stopper 342 of the pressing mechanism 34 contacts the ceiling portion of the recess 334 of the holding members 332 and 333, and the pressing force of the coil spring 341 is not applied to the bearing members 313 and 314 of the second transfer roller 31 via the pressing member 343. As a result, as illustrated in FIG. 7C, the bearing members 313 and 314 are spaced away from the positioning recessed portion 90 on the image forming apparatus body 1*a* side as the rear cover 80 is further opened, and the second transfer roller 31 contacts the first guide surface 92 of the positioning recessed portion 90.

In this event, as illustrated in FIG. 5, the distance R1 between the first turning support point 81 of the rear cover 8Q and the outer peripheral end of the bearing members 313 and 314 of the second transfer roller is shorter than the distance with the second transfer unit 30 at the operation position. The distance R1 is shorter than a distance R2 from the first turning supporting point 81 to the position of an end portion of the straight portion 93 of the positioning recessed portion 90 on the upstream side when the rear cover 80 is turned about the first turning support point 81.

Therefore, the rear cover 80 is opened without the bearing members 313 and 314 of the second transfer roller 31 contacting an end portion of the second guide surface 93 of the positioning recessed portion 90 on the image forming apparatus body 1*a* side. That is, the operation of opening the rear cover 80 is performed without requiring a force that resists against the pressing force of the coil spring 341.

To close the rear cover 80, on the other hand, as illustrated in FIG. 5, the rear cover 80 is turned in the counterclockwise direction in the drawing. With the rear cover 80 opened, the second transfer unit 30 is turned in the counterclockwise direction by its own weight, and stopped with the housing 33 of the second transfer unit 30 in contact with the transport guide 55 provided to the rear cover 80. In this event, the distance R1 between the first turning support point 81 of the rear cover 80 and the outer peripheral end of the bearing members 313 and 314 of the second transfer roller is shorter than the distance R2 from the first turning supporting point 81 to the position of an end portion of the straight portion 93 of the positioning recessed portion 90 on the upstream side.

Therefore, when the rear cover 80 is closed, as illustrated in FIG. 7C, the outer peripheral end of the bearing members 313 and 314 of the second transfer roller 30 does not contact an end portion of the second guide surface 93, which is positioned on the upstream side, of the positioning recessed portion 90 on the image forming apparatus body 1*a* side. Thus, the operation of closing the rear cover 80 is performed without requiring a force that resists against the pressing force of the coil spring 341.

When the rear cover 80 is further closed from the state illustrated in FIG. 7C, as illustrated in FIG. 7B, the bearing members 313 and 314 of the second transfer unit 30 are guided upward along the first guide surface 92, which is positioned on the downstream side, of the positioning recessed portion 90 on the image forming apparatus body 1*a* side, and stopped at the operation position at which the bearing members 313 and 314 contact both the first and second guide surfaces 92 and 93 of the positioning recessed portion 90. In this event, the rear cover 80 is not fully closed, and the abutment portion 37 of the second transfer unit 30 is slightly spaced away from the inner surface 82*a* of the rear cover 80.

When the rear cover 80 is fully closed from this state, as illustrated in FIG. 7A, the rear cover 80 is rotated in the counterclockwise direction, and the abutment portion 37 of the second transfer unit 30 abuts against the inner surface 82*a* of the rear cover 80. Then, the second transfer unit 30 is slightly displaced in the direction of being spaced away from the image forming apparatus body 1*a* via the bearing members 313 and 314, and the stopper 342 of the pressing mechanism 34 is slightly rotated in the counterclockwise direction. As a result, the bearing members 313 and 314 of the second transfer unit 30 are fixed in position in the positioning recessed portion 90 on the image forming apparatus body 1*a* side with the bearing members 313 and 314 pressed by the coil spring 341 of the pressing mechanism 34.

In the exemplary embodiment described above, the bearing members of the second transfer roller are used as the positioning projecting portion. However, the present invention is not limited thereto, and the positioning projecting portion may be provided to a support member for the second transfer unit or the like, for example.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an open/close member provided to an image forming apparatus body so as to be openable and closable by turning about a first turning support point; and a second transfer member attached to the open/close member so as to be rotatable about an axis of a second turning support point which is provided to the open/close member and to be positioned at an operation position with a positioning projecting portion contacting a positioning recessed portion provided to the image forming apparatus body, a distance between the first turning support point and an outer peripheral end of the positioning projecting portion at a time when the open/close member is opened being shorter than the distance at a time when the second transfer member is at the operation position; and holding members that rotatably support the second transfer member and integrally include a support portion, the support portion being provided with a turning portion that is rotatably mounted to the second turning support point, the turning portion having an opening portion that is wider than a thickness of the second turning support point, wherein while the open/close member is closing by rotating about the axis of the first turning support point, the positioning projecting portion first comes in contact with a guide surface of the positioning recessed portion, the guide surface being located on a downstream side along a rotating direction of the open/close member, and then the second transfer member is guided to the operation position by rotating about the axis of the second turning support position.

2. The image forming apparatus according to claim 1, wherein the positioning projecting portion includes a bearing member that rotatably supports a rotary shaft of the second transfer member.

3. The image processing apparatus according to claim 1, further comprising:

a pressing unit attached to the open/close member so as to be rotatable about the second turning support point to press the positioning projecting portion against the positioning recessed portion, wherein the second turning support point of the pressing unit is provided at a position closer to the open/close member than the rotary shaft of the second transfer member.

4. The image forming apparatus according to claim 3, wherein the second turning support point of the pressing unit is located at a position displaced toward one side from a line of action of a pressing force of the pressing unit, and the pressing unit includes an abutment portion provided opposite to the second turning support point across the line of action of the pressing force of the pressing unit to be brought into abutment with the open/close member.

5. The image forming apparatus according to claim 1, wherein a position of the second transfer member at a time when the open/close member is opened is restricted by a guide member provided to the open/close member to guide a recording medium to the second transfer member.

6. The image forming apparatus according to claim 1, further comprising:

a pressing unit attached to the open/close member so as to be rotatable about the second turning support point to press the positioning projecting portion against the positioning recessed portion, wherein the second turning support point of the pressing unit is located at a position displaced toward one side from a line of action of a pressing force of the pressing unit, and the pressing unit includes an abutment portion provided opposite to the second turning support point across the line of action of the pressing force of the pressing unit to be brought into abutment with the open/close member.

* * * * *